US009039517B2

(12) United States Patent
Buchholz et al.

(10) Patent No.: US 9,039,517 B2
(45) Date of Patent: May 26, 2015

(54) INTEROPERABILITY OF SERVERS AND SUPPORTED ELECTRONIC GAMING MACHINES OF DIFFERENT MANUFACTURERS

(75) Inventors: Dale R. Buchholz, Palatine, IL (US); Srinivyasa Murthy Adiraju, Vernon Hills, IL (US); Christopher J. Frattinger, Sparks, NV (US)

(73) Assignee: WMS Gaming Inc., Waukegan, IL (US)

( * ) Notice: Subject to any disclaimer, the term of this patent is extended or adjusted under 35 U.S.C. 154(b) by 1310 days.

(21) Appl. No.: 12/522,790

(22) PCT Filed: Jan. 8, 2008

(86) PCT No.: PCT/US2008/000237

§ 371 (c)(1),
(2), (4) Date: Jul. 10, 2009

(87) PCT Pub. No.: WO2008/094385

PCT Pub. Date: Aug. 7, 2008

(65) Prior Publication Data

US 2010/0048294 A1 Feb. 25, 2010

Related U.S. Application Data

(60) Provisional application No. 60/897,751, filed on Jan. 26, 2007.

(51) Int. Cl.
*G07F 17/32* (2006.01)

(52) U.S. Cl.
CPC ..... *G07F 17/323* (2013.01); *G07F 17/3225* (2013.01); *G07F 17/32* (2013.01)

(58) Field of Classification Search
USPC ..... 463/42
See application file for complete search history.

(56) References Cited

U.S. PATENT DOCUMENTS

| | | | | |
|---|---|---|---|---|
| 5,587,810 | A * | 12/1996 | Feldman | 358/442 |
| 6,314,520 | B1 | 11/2001 | Schell et al. | |
| 6,373,854 | B1 * | 4/2002 | Lee | 370/466 |
| 6,682,423 | B2 * | 1/2004 | Brosnan et al. | 463/29 |

(Continued)

FOREIGN PATENT DOCUMENTS

EP 0537481 A2 9/2006

OTHER PUBLICATIONS

Written Opinion corresponding to co-pending International Patent Application Serial No. PCT/US2008/000237, European Patent Office; dated Sep. 2, 2008; 6 pages.

(Continued)

*Primary Examiner* — Bach Hoang
(74) *Attorney, Agent, or Firm* — Nixon Peabody LLP

(57) ABSTRACT

An illustrative method controls a gaming device that supports wagering on games. A communication is received at a gaming device coupled to the gaming network from another gaming device coupled to the gaming network. A determination is made by the gaming device if proprietary information is present in the communication or requested to be transmitted by the communication from the gaming device to the another gaming device. A determination is made by the gaming device whether the another gaming device is a trusted source. The gaming device processes the proprietary information associated with the communication only if the gaming device determines that the another gaming device is a trusted source.

15 Claims, 4 Drawing Sheets

(56) References Cited

U.S. PATENT DOCUMENTS

| | | | | |
|---|---|---|---|---|
| 7,438,643 | B2 * | 10/2008 | Brosnan et al. | 463/42 |
| 7,698,480 | B2 * | 4/2010 | Bychkov et al. | 710/36 |
| 7,780,526 | B2 * | 8/2010 | Nguyen et al. | 463/29 |
| 7,839,804 | B2 * | 11/2010 | Abrol et al. | 370/261 |
| 8,057,298 | B2 * | 11/2011 | Nguyen et al. | 463/25 |
| 8,118,677 | B2 * | 2/2012 | Robb | 463/42 |
| 8,162,755 | B2 * | 4/2012 | Brosnan et al. | 463/42 |
| 8,261,100 | B2 * | 9/2012 | Paniagua et al. | 713/300 |
| 8,296,587 | B2 * | 10/2012 | Paniagua et al. | 713/300 |
| 8,370,650 | B2 * | 2/2013 | Paniagua et al. | 713/300 |
| 8,454,440 | B2 * | 6/2013 | Brosnan et al. | 463/42 |
| 8,545,333 | B2 * | 10/2013 | Brosnan et al. | 463/42 |
| 2002/0155887 | A1 * | 10/2002 | Criss-Puszkiewicz et al. | 463/29 |
| 2004/0092310 | A1 | 5/2004 | Brosnan et al. | |
| 2004/0132532 | A1 * | 7/2004 | Brosnan et al. | 463/42 |
| 2004/0166931 | A1 * | 8/2004 | Criss-Puszkiewicz et al. | 463/29 |
| 2004/0266417 | A1 * | 12/2004 | Janas | 455/419 |
| 2005/0193217 | A1 * | 9/2005 | Case et al. | 713/200 |
| 2006/0030409 | A1 | 2/2006 | Lechner et al. | |
| 2006/0100010 | A1 | 5/2006 | Gatto et al. | |
| 2007/0058794 | A1 * | 3/2007 | Abrol et al. | 379/202.01 |
| 2007/0150543 | A1 * | 6/2007 | Fong et al. | 709/206 |
| 2008/0059743 | A1 * | 3/2008 | Bychkov et al. | 711/163 |
| 2008/0098097 | A1 * | 4/2008 | Motoyama et al. | 709/221 |

OTHER PUBLICATIONS

International Search Report corresponding to co-pending International Patent Application Serial No. PCT/US2008/000237, European Patent Office; dated Sep. 2, 2008; 4 pages.

Gaming Standards Association, G2S™ Message Protocol v1.0.1 (includes Errata 1); Dated Jan. 17, 2007; (1242 pages).

* cited by examiner

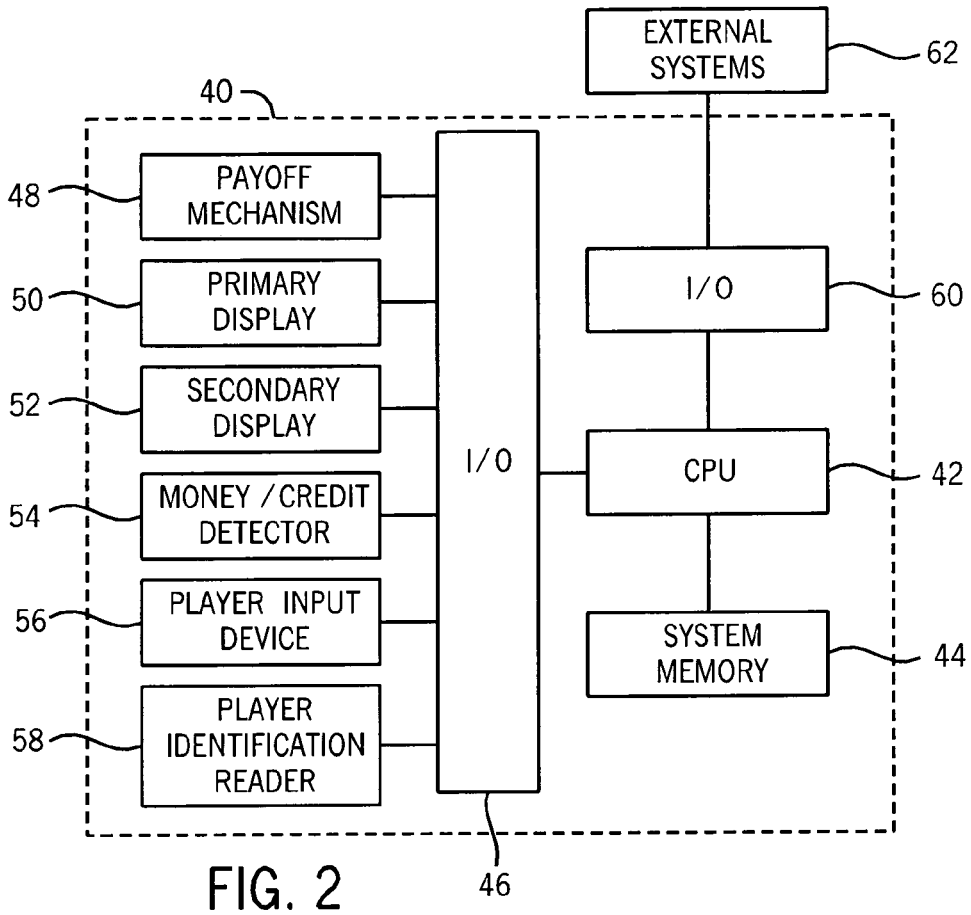
FIG. 2
FIG. 3
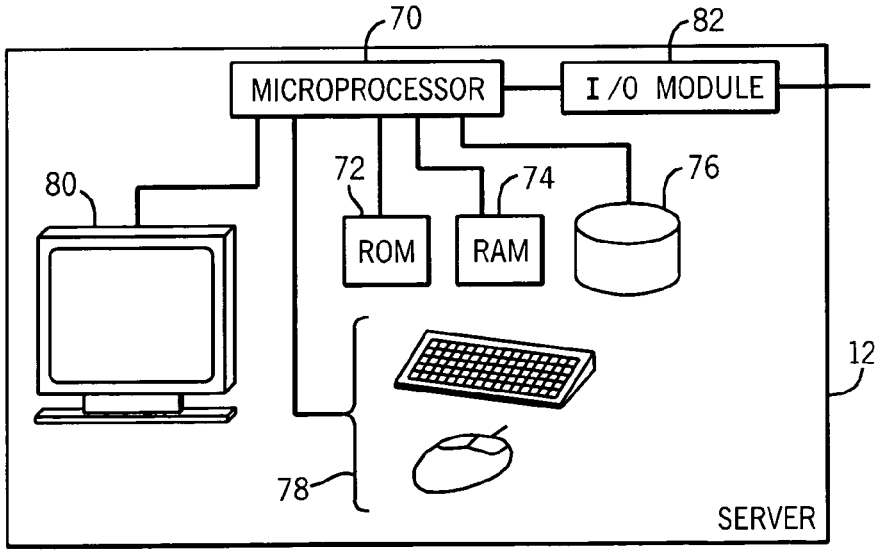

INTEROPERABILITY OF SERVERS AND SUPPORTED ELECTRONIC GAMING MACHINES OF DIFFERENT MANUFACTURERS

CROSS-REFERENCE TO RELATED APPLICATIONS

This application is a U.S. National Stage of International Application No. PCT/US2008/000237, filed Jan. 8, 2008, which claims the benefit of U.S. Provisional Application No. 60/897,751, filed on Jan. 26, 2007, both of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to electronic gaming machines (EGMs) and servers that support wagering on wagering games in a server-client relationship, and more particularly to the operation of servers and EGMs made by different manufacturers disposed in a common network.

BACKGROUND OF THE INVENTION

Gaming machines, such as slot machines and video poker machines, have been a cornerstone of the gaming industry for several years. EGMs, especially microprocessor-based gaming machines that follow a client/server configuration, provide flexibility through software control and the ability to communicate data and download software from a supporting server. Servers and corresponding EGMs made by different manufacturers may be installed in a gaming network having a common communication bus. The different servers maintain a list of all supported EGMs and configuration information for each. The servers also have a role in implementing wagering rules promulgated by the governmental jurisdiction, rules by the owner of the gaming software, and rules by the casino owner. Although certain common communication and control standards, e.g. Gaming Standards Association's Game-to-System (G2S) protocol is recommended to be followed by manufacturers, the EGMs and/or servers of the different manufacturers may also implement supplemental communications, commands, and data structures that are proprietary to the manufacturer. Therefore, there is a need to manage communications and control among servers and EGMs made by different manufacturers in a common communication network in order to support communication and control defined by a standards entity without compromising proprietary functions and/or features of a manufacturer.

SUMMARY OF THE INVENTION

According to one aspect of the present invention, an embodiment includes a method that controls a gaming device that supports wagering on games. A communication is received at a gaming device coupled to the gaming network from another gaming device coupled to the gaming network.

A determination is made by the gaming device if proprietary information is present in the communication or requested to be transmitted by the communication from the gaming device to the another gaming device. A determination is made by the gaming device whether the another gaming device is a trusted source. The gaming device processes the proprietary information associated with the communication only if the gaming device determines that the another gaming device is a trusted source.

According to another aspect of the invention, an embodiment includes a gaming device adapted to implement this method.

According to yet another aspect of the invention, a computer readable tangible storage medium is encoded with instructions for enabling a gaming device to perform the above method.

Additional aspects of the invention will be apparent to those of ordinary skill in the art in view of the detailed description of various embodiments, which is made with reference to the drawings, a brief description of which is provided below. The use of the same reference numeral in the drawings is utilized to denote identical or similar elements.

BRIEF DESCRIPTION OF THE DRAWINGS

FIG. 2 is a block diagram of a representative EGM.

FIG. 3 is a block diagram of a representative server.

DETAILED DESCRIPTION

Various embodiments of this invention can be utilized. The drawings and descriptions of embodiments of the invention exemplify its principles and are not intended to limit the broad aspect of the invention to only the illustrated embodiments.

Figure 1:
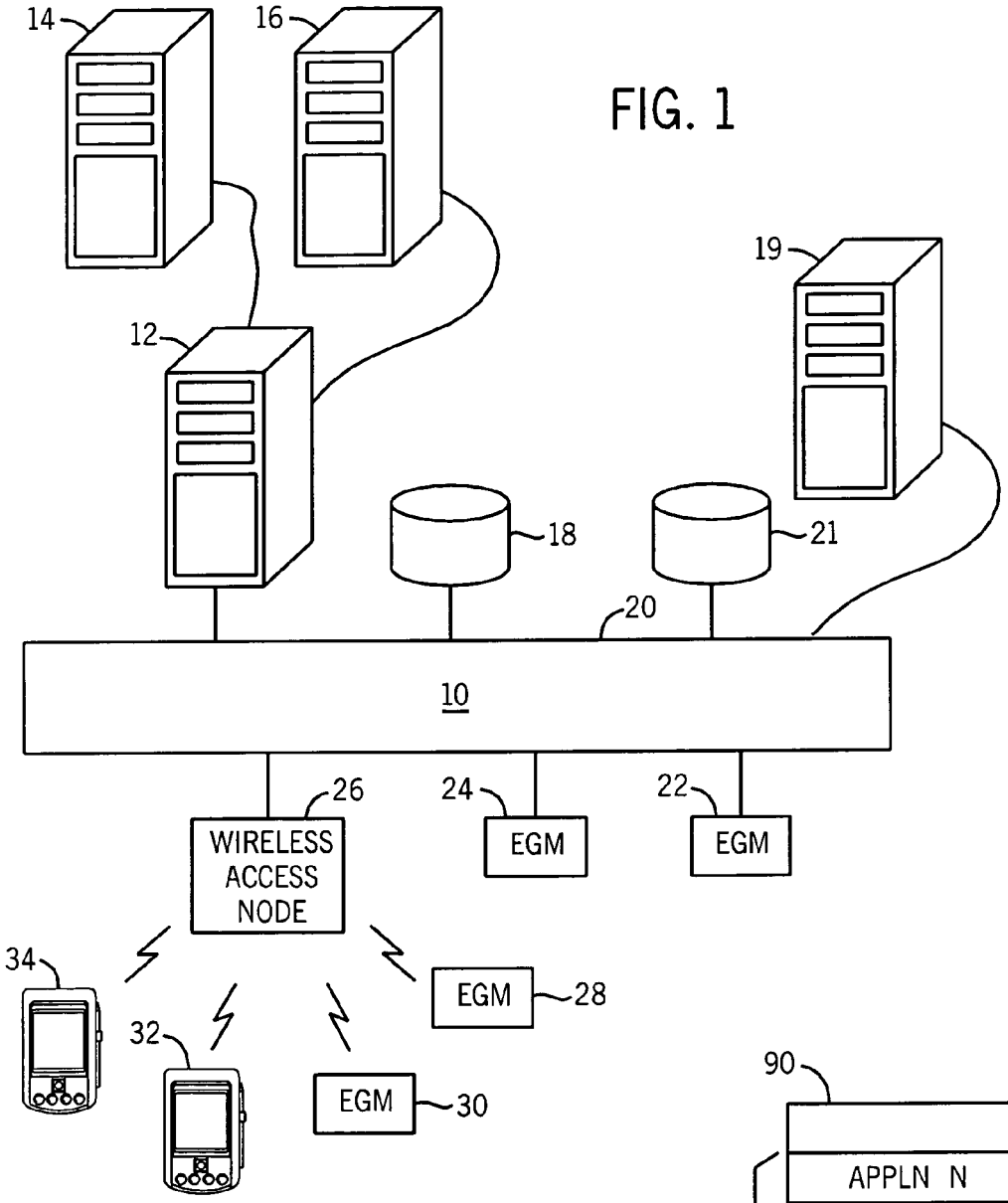
FIG. 1 is a block diagram of the gaming system suited for incorporation of an embodiment of the present invention.

Referring to FIG. 1, an illustrative gaming system 10 includes a server 12 supported by workstations 14 and 16 that provide licensing management and business rules management, respectively. A file server 18 provides a nonvolatile storage resource such as for storing configuration data used by the server and gaming software that can be downloaded to EGMs under the control of the server 12. Workstation 14 is responsible for licensing management and includes the responsibility for validating that an EGM has been authorized to receive the download of a new game upon the server 12 receiving a request to download the new game to the EGM. Server 12 operates under instructions from workstation 16 to implement a predetermined set of business rules, i.e. conditions, restrictions and/or requirements that impact the operation of the EGMs. For example, business rules may determine a maximum wager that can be placed at an EGM based on time of day, day of week, etc. Further the server may include a set of rules that govern the operation of the EGMs promulgated by the controlling jurisdiction. In this illustrative example, server 12 and file server 18 are made by a first manufacturer while server 19 and file server 21 are made by a different second manufacturer.

A communication bus 20 supports a bidirectional communication channel among the elements in gaming system 10. In the illustrative system, servers 12 and 19, file servers 18 and 21, stationary EGMs 22 and 24, and wireless access node 26 are coupled to bus 20. Stationary EGMs 28 and 30 are each coupled to bus 20 by a wireless communication link supported by the wireless access node 26. Similarly, mobile gaming machines 32 and 34 are each coupled to bus 20 by a wireless communication link supported by the wireless access node 26. In this illustrative example, EGMs 22, 28 and 32 are made by the first manufacturer and EGMs 24, 30 and 34 are made by the second manufacturer. Although certain communications and controls can be standardized by using the Gaming Standards Association's Game-to-System (G2S) protocol, the EGMs and server of the first manufacturer also implement communications, commands, and data structures that are proprietary to the first manufacturer. For example, certain EGM configuration information and/or control of certain parameters of an EGM may be proprietary to the manufacturer of the EGM and should only be communicated to and/or changed by a server made by the same manufacturer. Likewise, aspects or parameters of the server may be deemed proprietary, i.e. desired not to be disclosed to other manufacturers or shared with the equipment of other manufacturers. A method of interoperability of the devices of the first and second manufacturers disposed on a common communication bus is explained in detail below.

A "stationary" EGM refers to electronic gaming machine of a cabinet style that remains fixed during the play of a game by a user. A "mobile" gaming machine refers to an electronic gaming machine contained in a portable apparatus that can be transported by a user during the play of a game. For example, the portable apparatus of a mobile gaming machine could include a laptop computer with wireless capabilities, a personal digital assistant, a cellular telephone with appropriate input and output capabilities, etc.

FIG. 2 shows an exemplary EGM 40 that includes a central processing unit (microprocessor) 42 that is supported by system memory 44 that may include read-only memory, random access memory and a nonvolatile storage memory such as a hard drive. An input/output module 46 supports internal communications between the CPU 42 and various input and output devices. These devices may include a payoff mechanism 48, a primary display 50, a secondary display 52, a money/credit detector 54, a player input device 56 and a player identification reader 58. These devices are intended to be representative of a variety of input and output devices that may be employed by the EGM. A communications input/output device 60 provides an interface between the CPU 42 and external systems 62 enabling bidirectional communications for EGM 40. In accordance with the illustrative system 10, the input/output device 60 would support bidirectional data communications with bus 20 or bidirectional communications over a wireless link with wireless access node 26.

FIG. 3 is a representative computing apparatus 12 for a server. It is also applicable as architecture for the workstations 14 and 16 of FIG. 1. A microprocessor 70 performs processes and tasks based on stored program instructions. It is supported by read-only memory (ROM) 72, random access memory (RAM) 74 and nonvolatile data storage device 76. As will be understood by those skilled in the art, data and stored program instructions in ROM 72 is typically utilized by microprocessor 70 to initialize and boot the computing apparatus. An application program, e.g. a program that controls the implementation of one or more functions performed by the server, is stored in storage element 76. At least active portions of the application program will be typically stored in RAM 74 for ready access and processing by microprocessor 70. A variety of user inputs 78 such as a keyboard, keypad, and mouse can be utilized to control the operation of the server and applications running on it. A display screen 80 provides a visual output for an administrator of the server, e.g. characters and/or charts of operational parameters and visual representation of EGMs and related status of the EGMs. An input/output (I/O) module 82 provides a communication interface permitting microprocessor 70 to transmit and receive data with external nodes.

Figure 4:
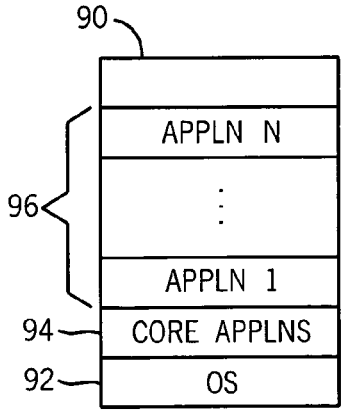
FIG. 4 is a functional block diagram illustrating software used to control the server and/or EGM.

FIG. 4 shows a functional block diagram illustrating software used to control the server. This organization also applies to the EGMs and workstations. The overall software environment 90 includes an operating system (OS) 92 such a Linux, core applications 94 that add functionality to the features of the OS and/or provide an interface with higher level applications 96 that are responsible for implementing user instructions and/or conditions. One of the applications 96, or at least a portion of an application, on the server is responsible for maintaining lists of supported EGMs and stored configuration data for each of the supported EGMs. Another of the applications 96, security interface software, is responsible for maintaining the confidentiality of proprietary information stored in or associated with the subject device. As used herein "operational software" refers to software that controls execution of the ongoing functions of the subject device, and "security interface software" refers to the software that controls proprietary communications and confidential data stored on or communicated with the subject device.

Table 1 illustrates communication protocols that could be utilized to identify devices and the manufacturer of the devices while delivering or requesting data and/or delivering a command to control a function or action.

TABLE 1

| Row | Destination | Source | Mfgr Id | field 1 standards based data | field 2 proprietary data | field 3 standards based command | field 4 proprietary command |
|---|---|---|---|---|---|---|---|
| 1 | 345 | 576 | WMS | data 1 | | command 1 | |
| 2 | 345 | WMS-10 | | data 1 | | command 1 | |
| 3 | WMS-123 | WMS-10 | | | data 2 | | command 2 |
| 4 | WMS-123 | AGC-03 | | data 1 | | | |
| 5 | WMS-123 | AGC-03 | | | data 2 | | |
| 6 | ALL | AGC-03 | | | | command 1 | |

Each row of Table 1 represents an illustrative communication, e.g. a packet, transmitted from one device in the gaming system to another device in the gaming system. The Destination and Source columns represent a destination address of the device to receive the packet and the address of source of the device originating the packet, respectively. The Manufacturer Identification (Mfgr Id) column can be utilized to identify the manufacturer of the source device if such information is not available as part of the address. The fields 1 and 2 may contain data where the data in field 1 is standards based data, i.e. a field defined by a standards entity that contains non-proprietary manufacturer data, and the data in field 2 is proprietary to the manufacturer. Similarly, fields 3 and 4 may contain commands where field 3 is a field defined by a standards entity containing a standardized command, i.e. not proprietary to the manufacturer, and field 4 contains a command that is proprietary to the manufacturer. Fields 1 and 3 contain only non-proprietary information, and fields 2 and 4 contain only proprietary information. Although a packet could contain both data and commands, in one design each communication (packet) would contain one or the other but not both. Similarly, a packet could contain both standardized information and proprietary information, but in one design a communication would contain only one or the other but not both. A likely scenario is believed to be where each packet carries only one type of information associated with one of the four fields.

In row 1 a packet originated by WMS Gaming Inc. device 576 contains standard based information in fields 1 and 3 addressed to device 345. In this example, the manufacture identification field was used to identify the manufacturer of the device originating the packet. Because only standards based information is being conveyed, the destination device 345 should recognize and accept this information. Row 2 illustrates a packet that is identical to the packet of row 1 except that the source address is configured to include identification of the manufacturer (WMS). Row 3 illustrates a packet originated by WMS device WMS-10 having a destination of another WMS device WMS-123. This packet contains proprietary data in field 2 and a proprietary command in field 4. Although proprietary information is being conveyed, it will be accepted by the destination device since it comes from a trusted source, i.e. another device of the same manufacture. In row 4 a packet originated by Acme Gaming Corp. (AGC) device AGC-03 contains standardized based data in field 1 addressed to WMS Gaming Inc. device WMS-123. This data will be accepted by WMS-123 since only standards based data is being conveyed. In row 5 a packet from AGC-03 contains proprietary data in field 2 addressed to WMS-123. This proprietary data will be rejected by WMS-123 because it does not come from a trusted source, i.e. another WMS Gaming Inc. device. The packet from AGC-03 would have also been rejected by WMS-123 if it had contained only a proprietary command of the same reason. In row 6 a packet from AGC-03 contains only a standardized command in field 3 and has a destination address of ALL, i.e. a broadcast type packet intended to be conveyed to all other gaming devices in the network. Because only a standardized command is contained in this packet, each of the recipient gaming devices in the network should accept the packet and process the standardized command contained in it.

Figure 5:
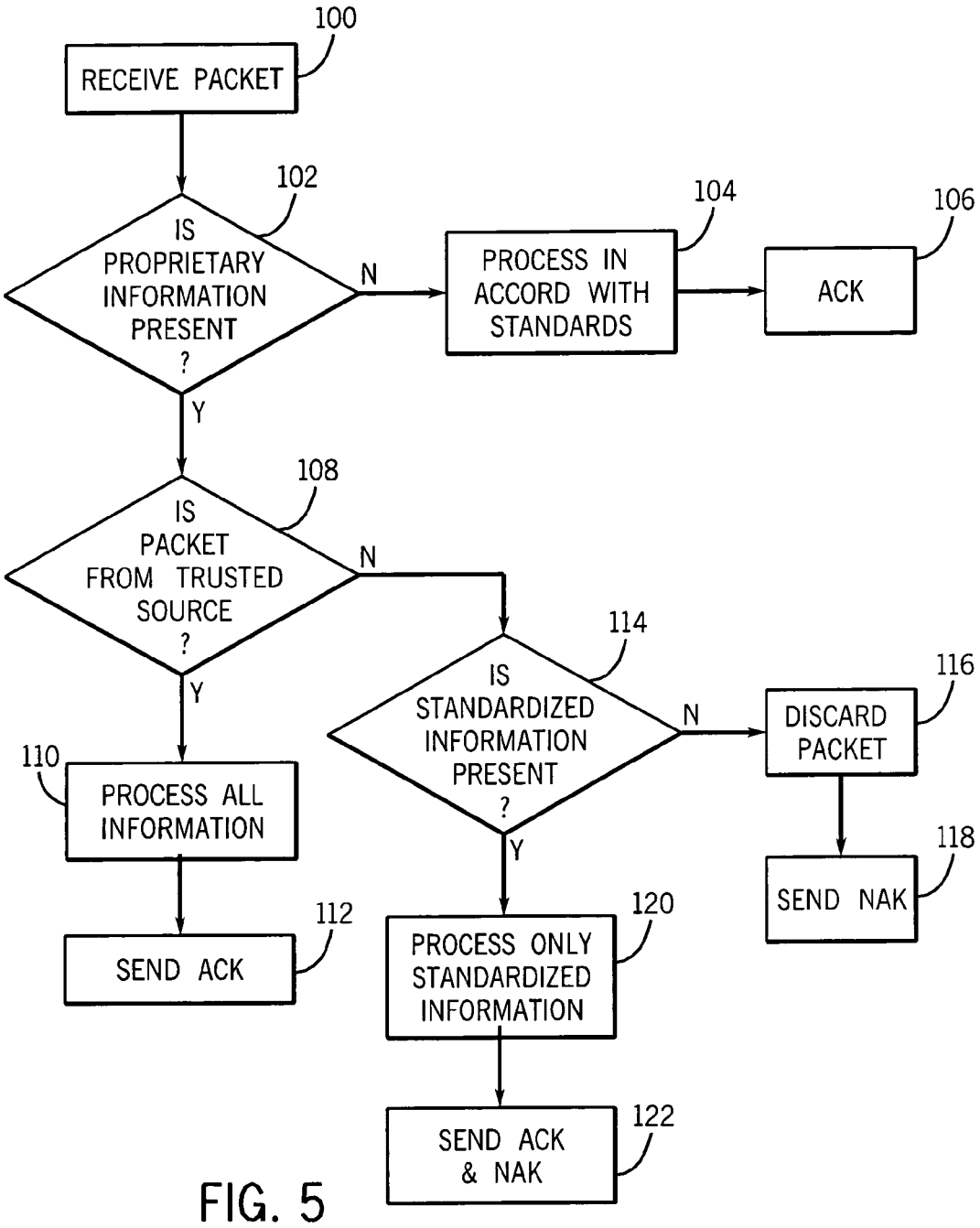
FIG. 5 is a flow diagram of an illustrative method in accordance with an embodiment of the present invention.

FIG. 5 is a flow diagram of an illustrative method for the handling of packets received by an EGM where the packets may contain standardized information, proprietary information, or both. The packets may be transmitted by a server or another EGM in the network. In step 100 a packet is received. In this illustrative method it is assumed that the packet is transmitted from a server and is received by an EGM. In step 102 a determination is made of whether proprietary information is present in the packet. Various fields of the packet can be defined by the manufacturer to represent proprietary information. For example, commands or data associated with the configuration of the EGM could be defined as proprietary to ensure that the EGM can only be configured by a trusted source such as another device made by the same manufacturer, e.g. a server or another EGM by the same manufacturer. Additionally, other data or commands can also be predetermined by the manufacturer to be proprietary information. A NO determination by step 102, indicating that proprietary information was not present in the packet, results in the packet being processed in accordance with standards in step 104. Following this processing, the EGM transmits a reply acknowledgment (ACK) in step 106 thus concluding the processing of the packet.

A YES determination by step 102, indicating that proprietary information was present in the packet, leads to a determination in step 108 of whether the packet is from a trusted source, e.g. another device made by the manufacturer of the EGM processing the packet. A YES determination by step 108 causes the EGM to process all of the information contained in the packet at step 110. That is, since the packet is from a trusted source all standard and proprietary information contained in the packet is accepted and acted upon by the receiving device. In step 112 an ACK is transmitted in reply.

A NO determination by step 108 results in a determination in step 114 of whether standardized information is present in the packet. A NO determination by step 114, indicating that only proprietary information from a non-trusted source is present, results in the packet being discarded in step 116. That is, any information contained within the packet will not be acted upon by the receiving EGM. In step 118 a negative acknowledgment (NAK) is transmitted to the originating source of the packet indicating a lack of acceptance. Preferably, this NAK will be a predetermined type that will indicate to the source that the packet was received by the destination EGM but that the contents of the packet were not processed, i.e. acted upon. Such a NAK does not provide the originating node with any information about the receiving node except that the originating node's communication was received and not acted upon by the receiving node.

A YES determination by step 114, indicating that standardized information as well as proprietary information is present in the packet from a non-trusted source, causes only the standardized information in the packet to be processed at step 120, with the proprietary information present in the packet being discarded. In step 122 the EGM transmits an ACK and NAK back to the source device where the ACK acknowledges receipt and processing of the standardized information, and the NAK indicates receipt of the packet with the proprietary information not being processed. Alternatively, separate ACK and NAK reply messages could be conveyed by transmitting a single reply message of a predetermined type that would provide the same information to the source.

Figure 6:
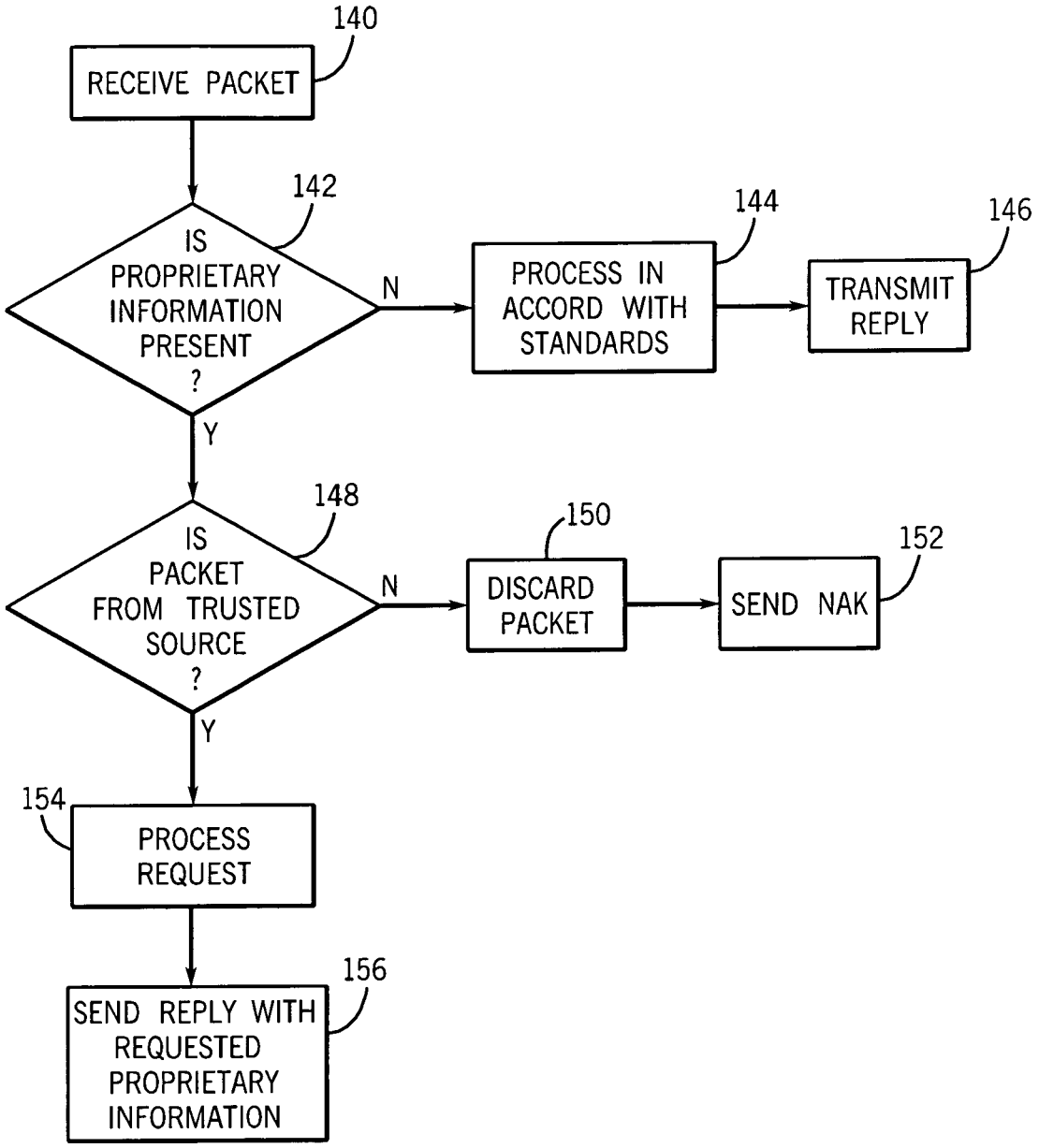
FIG. 6 is a flow diagram of another illustrative method in accordance with an embodiment of the present invention.

FIG. 6 is a flow diagram of another illustrative method in which the received packet does not carry proprietary information but contains an instruction/command requesting that the receiving device, e.g. EGM, send a reply back to the source device that would include proprietary information of the EGM. In step 140 a packet is received. In this example it is assumed that the packet is transmitted by a server and received by an EGM, although any gaming device in the network could have originated a packet having a destination of another gaming device in the network. In step 142 a determination is made whether the packet contains a request for proprietary information of the EGM. A NO determination by step 142 results in the packet and its request being processed in accordance with standards as indicated by step 144. Following the processing of the request, the EGM transmits a reply containing the requested information to the source device that originated the packet in step 146.

A YES determination by step 142 results in a further determination of whether the packet was transmitted from a trusted source, e.g. a gaming device made by the same manufacturer that made the EGM. A NO determination by step 148 causes the packet to be discarded as indicated at step 150, i.e. the request for proprietary information will not be complied with by the EGM. It will be understood that the determination of whether the requested information is proprietary or not will be made by the device from which the information is sought. The EGM transmits a NAK to the source device as indicated at step 152 where the NAK preferably represents to the source device that the EGM successfully received the packet but that the requested information will not be provided to the source device.

A YES determination by step 148, indicating that proprietary information has been requested from a trusted source, results in the EGM processing the request as indicated in step 154. The EGM transmits a reply containing the requested proprietary information to the trusted source device in step 156.

The exemplary methods permit a manufacturer to maintain predetermined features and functions of its gaming devices as proprietary while complying with standardized communication and control as defined by a standards entity.

The server and EGMs in one example employs one or more computer readable signal bearing tangible media that stores software, firmware and/or assembly language for performing one or more portions of one or more embodiments of the invention. The computer-readable signal-bearing tangible media in one example comprises one or more of a magnetic, electrical, optical, biological, and atomic data storage medium. For example, the computer-readable signal-bearing media may comprise floppy disks, magnetic tapes, CD-ROMs, DVD-ROMs, hard disk drives, USB flash memory and electronic memory modules.

The steps or operations described herein are only examples. There may be many variations to these steps or operations without departing from the spirit of the invention. For instance, the steps may be performed in a differing order, or steps may be added, deleted, or modified. Although software is described in the illustrative example, the functions of the software may be incorporated as part of firmware, a logic array, or hardware based logic. The exemplary communications are described as being implemented as packets but other types of bidirectional communications and communication protocols could be used. A determination that first and second nodes are trusted sources to each other can be made during a first initial communication session in which a private virtual channel, secure socket, https, or other ongoing channel is created between these nodes such that future communications between the first and second nodes over the ongoing channel are assumed to be trusted without having to test each later communication. Alternatively, an EGM can be configured with information defining trusted nodes prior to any communications with a trusted node such as by loading such information into the EGM via a local user interface. Although the above illustrative method is described for processing packets received by an EGM, the same or similar process can be utilized by a server for processing received packets. The transmission of the fields 1-4 explained above may be provided in a format that supplements the fields and/or structure of a packet defined by standards. Although the proprietary data and commands are illustrated as being defined by fields that are associated only with proprietary information, it will be apparent to those skilled in the art that other ways can be utilized to identify proprietary information. For example, the use of a predetermined preamble or flag preceding the proprietary information, labels, specified location in a data structure or packet, the use of encrypted data, etc. as well as other techniques could be utilized to permit proprietary information to be identified as such.

Each of these embodiments and obvious variations thereof are contemplated as falling within the spirit and scope of the claimed invention, which is set forth in the following claims.

What is claimed is:

1. A method for communicating proprietary information and standardized information in a gaming network that supports electronic gaming machines that permit wagering on casino wagering games, the gaming machines including a first gaming machine and a second gaming machine, the first gaming machine including a cabinet housing components for the first gaming machine, a microprocessor, a display on the cabinet, an electronic input device, and an electronic communications interface device, the second gaming machine including a cabinet housing components for the second gaming machine, a microprocessor, a display on the cabinet of the second gaming machine, an electronic input device, and an electronic communications interface device, the method comprising the steps of:

(a) receiving at the electronic communications interface device of the first gaming machine coupled to the gaming network a communication formatted in a data structure according to a protocol from the second gaming machine coupled to the gaming network, the protocol including a manufacturer identification;

(b) determining by the microprocessor of the first gaming machine if the communication includes an instruction from the second gaming machine requesting that the first gaming machine send proprietary information to the second gaming machine;

(c) in response to the microprocessor of the first gaming machine determining that the communication includes the instruction, determining by the first gaming machine whether the second gaming machine is a trusted source by evaluating the manufacturer identification in the protocol;

(d) in response to the first gaming machine determining that the second gaming machine is a trusted source, the microprocessor of the first gaming machine transmitting via the electronic communications interface device of the first gaming machine the requested proprietary information in a reply to the electronic communications interface device of the second gaming machine; and (e) in response to the first gaming machine determining that the second gaming machine is not a trusted source, the microprocessor of the first gaming machine not transmitting to the second gaming machine the requested proprietary information.

2. The method of claim 1 wherein step (c) determines that the second gaming machine is a trusted source if the manufacturer of the second gaming machine and the manufacturer of the first gaming machine corresponds to the same manufacturer.

3. The method of claim 1 further comprising disregarding the communication from the second gaming machine upon the first gaming machine determining that:

proprietary information is requested to be transmitted from the first gaming machine to the second gaming machine, standardized information is not present in the communication, and the second gaming machine is not a trusted source by evaluating the manufacturer information in the protocol.

4. A gaming machine that supports wagering on casino wagering games where the gaming machine is coupled to a gaming network, the gaming machine comprising:

a cabinet housing components for the gaming machine;

a display on the cabinet;

an electronic input device;

an electronic communications interface device;

a memory;

a microprocessor based system adapted to receive at the electronic communications interface device a communication formatted according to a protocol from a second gaming machine coupled to the gaming network, the protocol including a manufacturer identification indicating a manufacturer of the second gaming machine;

the microprocessor based system adapted to determine if the communication includes an instruction from the second gaming machine requesting that the gaming machine send proprietary information to the second gaming machine;

the microprocessor based system adapted to determine whether the second gaming machine is a trusted source by evaluating the manufacturer identification in the protocol;

the microprocessor based system adapted to transmit, via the electronic communications interface device, the requested proprietary information in a reply to the electronic communications interface device of the second gaming machine if it has been determined that the second gaming machine is a trusted source;

the microprocessor based system, upon determining by the gaming machine that the second gaming machine is not a trusted source, not transmitting to the second gaming machine the requested proprietary information.

5. The gaming machine of claim 4 further comprising the memory storing a second manufacturer identification identifying a second manufacturer of the gaming machine and the microprocessor based system adapted to determine that the second gaming machine is a trusted source if the manufacturer of the gaming machine corresponds to the second manufacturer.

6. The gaming machine of claim 4 further comprising the microprocessor based system disregarding the communication from the second gaming machine upon the gaming machine determining that:

proprietary information is requested to be transmitted from the gaming machine to the second gaming machine, and standardized information is not present in the communication, and determining the second gaming machine is not a trusted source, the microprocessor based system further processing the information associated with the communication according to the protocol without regard of whether the second gaming machine is a trusted source.

7. A tangible computer readable storage medium encoded with instructions for controlling a first gaming machine that supports wagering on casino wagering games, the first gaming machine including a cabinet housing components for the gaming machine, a microprocessor, a display on the cabinet, an electronic input device, and an electronic communications interface device, the instructions comprising:

computer readable storage instructions for receiving at the electronic communications interface of the first gaming machine coupled to the gaming network a communication formatted according to a protocol from a second gaming machine coupled to the gaming network, the protocol including a manufacturer identification indicating a manufacturer of the second gaming machine, the second gaming machine including a cabinet housing components for the second gaming machine, a microprocessor, a display on the cabinet of the second gaming machine, an electronic input device, and an electronic communications interface device;

computer readable storage instructions for determining by the microprocessor of the first gaming machine if the communication includes an instruction from the second gaming machine requesting that the first gaming machine send proprietary information to the second gaming machine;

computer readable storage instructions for determining by the first gaming machine whether the second gaming machine is a trusted source by evaluating the manufacturer information in the protocol;

computer readable storage instructions for transmitting via the electronic communications interface device of the first gaming machine the requested proprietary information in a reply to the electronic communications interface device of the second gaming machine upon the first gaming machine determining that the second gaming machine is a trusted source; and computer readable storage instructions for not transmitting to the second gaming machine the requested proprietary information upon determining by the first gaming machine that the second gaming machine is not a trusted source.

8. The tangible computer readable storage medium of claim 7 further comprising:

computer readable storage instructions that determine that the second gaming machine is a trusted source if the manufacturer of the second gaming machine and the manufacturer of the first gaming machine are the same manufacturer.

9. The tangible computer readable storage medium of claim 7 further comprising computer readable storage instructions that disregard the communication from another gaming device upon the first gaming machine determining that:

proprietary information is requested to be transmitted from the first gaming machine to the second gaming machine, standardized information is not present in the communication, and the second gaming machine is not a trusted source by evaluating the manufacturer information in the protocol.

10. The method of claim 1, wherein the second gaming machine is on a common communications bus with the first gaming machine, and wherein the communication includes a first manufacturer identification indicating a manufacturer of the second gaming machine, the method further comprising:

receiving at the first gaming machine a second communication communicated according to the protocol from a third gaming machine of the electronic gaming machines coupled to the gaming network on the common communications bus, the second communication including a second manufacturer identification indicating a manufacturer of the third gaming machine, the manufacturer of the third gaming machine being the same as a manufacturer of the first gaming machine;

determining by the microprocessor of the first gaming machine if proprietary information is present in the second communication or requested to be transmitted by the second communication from the first gaming machine to the third gaming machine; and the first gaming device determining that the third gaming machine is a trusted source by evaluating the second manufacturer information, and responsive thereto, processing according to the protocol by the microprocessor of the first gaming machine all information associated with the second communication, wherein the evaluating includes determining from the manufacturer identification whether the manufacturer of the second gaming machine is identical to a manufacturer of the first gaming machine.

11. The method of claim 1, wherein the protocol is based on the Gaming Standards Association Game-to-System message protocol.

12. The method of claim 1, wherein in response to the first gaming machine determining that the second gaming machine is not a trusted source, the microprocessor of the first gaming machine sending a negative acknowledgement to the second gaming machine indicating that the instruction requesting the proprietary information was received by the first gaming machine.

13. The gaming machine of claim 4, wherein the microprocessor based system is further adapted to send a negative acknowledgement to the second gaming machine indicating that the instruction requesting the proprietary information was received by the gaming machine in response to the microprocessor based system determining that the second gaming machine is not a trusted source.

14. The tangible computer readable storage medium of claim 7, further comprising computer readable storage instructions for sending a negative acknowledgement to the second gaming machine indicating that the instruction requesting the proprietary information was received by the first gaming machine in response to the first gaming machine determining that the second gaming machine is not a trusted source.

15. The method of claim 1, further comprising:

receiving at the first gaming machine a second communication formatted in a second data structure according to the protocol from a third gaming machine coupled to the gaming network, wherein the second data structure includes standards-based data, proprietary data, a standards-based command, or a proprietary command;

determining by the microprocessor of the first gaming machine if proprietary information is present in the second communication;

in response to the microprocessor of the first gaming machine determining that the proprietary information is present in the second communication, determining by the first gaming machine whether the third gaming machine is a trusted source by evaluating the manufacturer identification in the protocol;

in response to the first gaming machine determining that the third gaming machine is a trusted source, the microprocessor of the first gaming machine processing all information including the proprietary information and any standardized information associated with the second communication, wherein the includes accepting and acting upon the information by the first gaming device; and in response to the first gaming machine determining that the third gaming machine is not a trusted source, the microprocessor of the first gaming machine not transmitting to the third gaming machine any standardized information, but not the requested proprietary information, associated with the communication.

* * * * *